US009427973B1

(12) United States Patent
Pomfret

(10) Patent No.: US 9,427,973 B1
(45) Date of Patent: Aug. 30, 2016

(54) POSTAGE METER PRINTER MODULE AND HOUSING THEREFOR

(71) Applicant: DATAPRINT TECHNOLOGY, INC., Woodside, NY (US)

(72) Inventor: John A Pomfret, East Lyme, CT (US)

(73) Assignee: DATAPRINT TECHNOLOGY, INC., Woodside, NY (US)

( * ) Notice: Subject to any disclaimer, the term of this patent is extended or adjusted under 35 U.S.C. 154(b) by 0 days.

(21) Appl. No.: 14/999,036

(22) Filed: Mar. 22, 2016

(51) Int. Cl.
*B41J 2/175* (2006.01)

(52) U.S. Cl.
CPC ..... *B41J 2/1752* (2013.01); *B41J 2/17513* (2013.01); *B41J 2/17526* (2013.01); *B41J 2/17546* (2013.01)

(58) Field of Classification Search
CPC B41J 2/1752; B41J 2/17526; B41J 2/17513; B41J 2/1753; B41J 2/17533; B41J 2/17546; B41J 2/17553; G07B 17/00508; G07B 2017/00532; G07B 2017/00629
See application file for complete search history.

(56) References Cited

U.S. PATENT DOCUMENTS

| | | | | |
|---|---|---|---|---|
| 5,280,300 | A | 1/1994 | Fong et al. | |
| 5,440,333 | A * | 8/1995 | Sykora et al. | B41J 2/17513 347/87 |
| 5,917,527 | A * | 6/1999 | Boyd et al. | B41J 2/17513 347/85 |
| 6,234,626 | B1 | 5/2001 | Axtell et al. | |
| 6,238,038 | B1 | 5/2001 | Gilham et al. | |
| 6,378,978 | B1 | 4/2002 | Chang et al. | |
| 6,409,326 | B1 | 6/2002 | Giles et al. | |
| 7,048,366 | B2 | 5/2006 | Alexia et al. | |
| 8,262,178 | B2 | 9/2012 | Muhl | |
| 8,544,988 | B1 | 10/2013 | Hooker et al. | |
| 8,894,192 | B2 | 11/2014 | Hooker et al. | |
| 2014/0063151 | A1 | 3/2014 | Hooker et al. | |

FOREIGN PATENT DOCUMENTS

| | | |
|---|---|---|
| EP | 0 393 896 A2 | 10/1990 |
| EP | 0 522 809 A2 | 1/1993 |
| EP | 0 717 374 A2 | 5/1996 |

* cited by examiner

*Primary Examiner* — Anh T. N. Vo
(74) *Attorney, Agent, or Firm* — Ira S. Dorman

(57) ABSTRACT

A module for mounting and use in a postage meter for printing postage includes a housing and two ink cartridges for ink-jet printing, each of the cartridges having a flexible electrical circuit member operatively attached thereto, with one of the electrical circuits including a microprocessor. The housing consists of two lateral components, each containing one of the ink cartridges, a central panel component interposed between the lateral components, and elements for maintaining the components in assembly. The ink cartridges are placed into cavities formed by the lateral components, which are then assembled on opposite sides of the central component with the flexible circuit members suitably arranged, to produce the inking module. The central panel includes features for applying laterally outward biasing force upon the seated ink cartridges, and structure is provided on the module to facilitate mounting and retention in a postage printing machine.

18 Claims, 3 Drawing Sheets

POSTAGE METER PRINTER MODULE AND HOUSING THEREFOR

BACKGROUND OF THE INVENTION

Inking modules for use in postage meters for printing postage are well known in the art. Such modules normally comprise a housing containing one or more ink-jet printing cartridges and an integrated flexible circuit, incorporating a microprocessor, for interfacing the cartridges and the housing with a postage meter.

U.S. Pat. Nos. 6,238,038 and 8,894,192 provide comprehensive expositions of the state of the art, as pertinent to the present invention; they are directed to a secure digital postage print module and to a recyclable and remanufacturable microprocessor-based postal evidencing module, respectively. Despite the wide commercial acceptance of postage meter printer modules of the kind disclosed in the foregoing patents and other prior art, the industry desires an inking module that employs a less complex housing, which is simpler and more economical to fabricate and to use for manufacturing a module.

BRIEF SUMMARY OF THE INVENTION

Accordingly, broad objects of the present invention are to provide a novel housing for containing standard ink-jet printing cartridges, and a novel inking module comprised of an assembly of such a housing and two ink cartridges, which housing is of relatively incomplex and inexpensive construction and facilitates secure, stable, and simplified assembly with standard ink-jet printing cartridges, by way of lateral loading rather than insertion from the top, to provide a module that is of sleek and aesthetically pleasing appearance and can readily be installed in a standard postage printing meter.

It is also an object of the invention to provide such a housing which may be constructed for facile and nondestructive manual disassembly to permit ready replacement of the printing cartridges for remanufacture of the module.

It has now been found that certain of the foregoing and related objects of the invention attained by the provision of a housing for the containment of two ink cartridges for ink-jet printing, the housing being comprised of a pair of similarly configured lateral components (distinguished from one another essentially by features that may be necessary to house the ink cartridges in an offset, or staggered, relationship) and a generally planar central panel component. Each of the lateral components includes a side panel having a peripheral edge, and a peripheral wall that extends laterally from the peripheral edge and includes a top portion, a bottom portion, a front portion, and a rear portion; the peripheral wall and the side panel cooperatively define an ink cartridge-receiving cavity in each of the lateral components.

The bottom portion of the peripheral wall of the each lateral component has a gap that extends from the free edge of the wall toward the side panel, and that is dimensioned and configured for receiving the ink-discharge nozzle of a contained cartridge. The front portion of the peripheral wall of at least one of the lateral components is formed with a slot that extends from the free edge toward the side panel and is dimensioned and configured (i.e., preferably defined by an inverted, broad T-shaped periphery) for the receipt therethrough of an electrical circuit member, normally in the form of a strip, or flexible circuit, that integrates one or more microprocessors, circuitry, and terminals for making operative electrical connections and programming of the microprocessor(s).

The housing also includes a generally planar central panel component having a peripheral edge portion. The components of the housing are so dimensioned and configured that the free edges of the peripheral walls of the lateral components engage the peripheral edge portion of the central panel component when the lateral components are assembled against opposite sides there, and means is provided for securing the components in such assembly. In its external configuration, the assembled housing is generally symmetrical about a plane of the central panel component.

The means for securing will desirably be so constructed as to disengageably secure the housing components, to permit ready disassembly, and such means for securing will preferably be constructed so as to permit reuse, after disassembly, to enable replacement of the ink cartridges for remanufacture of the module. An indentation, or slot-like recess, may be provided at the joint between the peripheral edge portion of the central panel component and the free edge of a lateral housing component for receipt of a tool to facilitate prying the components apart. Alternatively, the means for securing may be so constructed as to prevent reuse after disassembly of the housing components, such as by employing frangible, or break away, elements.

In either case, the means for securing will beneficially comprise a plurality of pins extending laterally inwardly from at least one of the lateral housing components, and a corresponding plurality of holes in at least the other lateral housing component, the pins being aligned with the holes and being dimensioned and configured to tightly engage the surrounding surfaces (i.e., for friction fitting) to secure the components of the housing in assembly; it will be appreciated that selectively positioned pins and corresponding holes may be provided on both lateral components. Where such pins are employed, a plurality of apertures will be provided in the peripheral edge portion of the central panel component, the apertures being dimensioned, configured, and spaced about the central panel component for receiving therethrough the pins on the lateral housing component(s).

Most desirably, the central panel component will have biasing means formed thereon for exerting laterally outward biasing force upon an ink cartridge seated in the cartridge-receiving cavity of each lateral component. Such biasing means will advantageously comprise a multiplicity of resiliently deflectable fingers integrally formed on the central panel component, with each of a first plurality of the fingers having a contact element thereon that project from one side of the central panel component and each of a second plurality of the fingers having a contact element thereon that project from the opposite side thereof.

The lateral housing component in which the front portion of the peripheral wall is slotted for receipt of an electrical circuit member, as hereinabove mentioned, will desirably include support structure within its cavity, located adjacent the slot and constructed for supporting a distal end portion of an inserted flexible circuit member. Locating tabs will advantageously be provided at a bottom, front corner portion of each of the components to facilitate correct positioning of the housing in the postage meter in which it is used.

Other objects of the invention are attained by the provision of a module for mounting and use in a postage meter for printing postage, comprising a housing, as hereinabove and hereinafter described, and two ink cartridges for ink-jet printing, each of the cartridges having an ink-discharge nozzle and having a flexible electrical circuit member attached for operative electrical connection to a postage meter for controlling the discharge of ink through the nozzle thereof. Thus, the module comprises an assembly of the lateral housing components, positioned on opposite sides of the central panel component and secured by the securing means with the free edges of the peripheral walls of the lateral components engaging the peripheral edge portion of the central panel component, with one of the ink cartridges being seated in the cartridge-receiving cavity of each of the lateral components, and with the central panel component interposed between the cartridges. The ink-discharge nozzles of the ink cartridges and the attached, operatively connected flexible electrical circuit members extend through the gaps in the bottom portions of the peripheral walls of the lateral components to provide portions of the circuit members exposed, for electrical contact, on the exterior of the front portions of the peripheral walls of the lateral components. The flexible electrical circuit member of the ink cartridge seated in the cavity of one of the lateral components extends through the slot in the front portion of the peripheral wall thereof, and has a distal end portion, which carries a microprocessor and programming points therefor, contained in the ink cartridge-receiving cavity of that component.

Normally, the peripheral walls of the lateral components of the housing will engage the peripheral edge portion of the central panel component in direct surface contact, and the housing will desirably be generally symmetrical, in external configuration, about a plane of its central panel component. In preferred embodiments of the module, the central panel component will have biasing means thereon comprised of elements that act in opposite directions for exerting lateral biasing force upon both of the ink cartridges seated in the respective cavities of their lateral housing components, the biasing means most desirably being integrally formed on the central panel component. In most instances the flexible electrical circuit member employed in the module will be of strip form and will have a distal end portion on which a microprocessor, and programming points (electrical contacts) therefor, is provided.

DETAILED DESCRIPTION OF THE INVENTION

Figure 1:
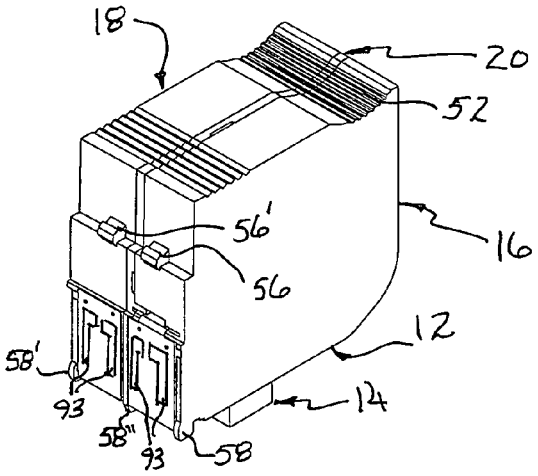
FIG. 1 is a perspective view of a module for use in a postage meter for printing postage, embodying the present invention and being taken from the front, upper right side thereof (it will be appreciated that designation of the right and left sides and front and rear of the module, and the constituent housing, is somewhat arbitrary).
Figure 2:
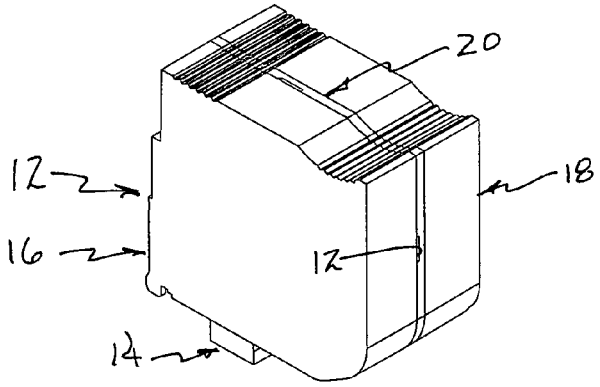
FIG. 2 is a perspective view of the module of the invention, taken from the rear, upper left side thereof.
Figure 3:
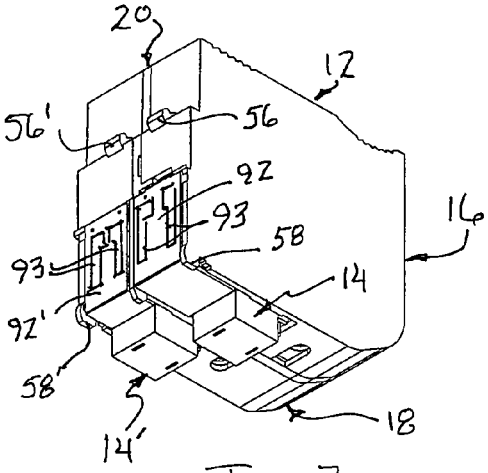
FIG. 3 is a perspective view of the module of the invention, taken from the front, bottom right side thereof.
Figures 4, 5:
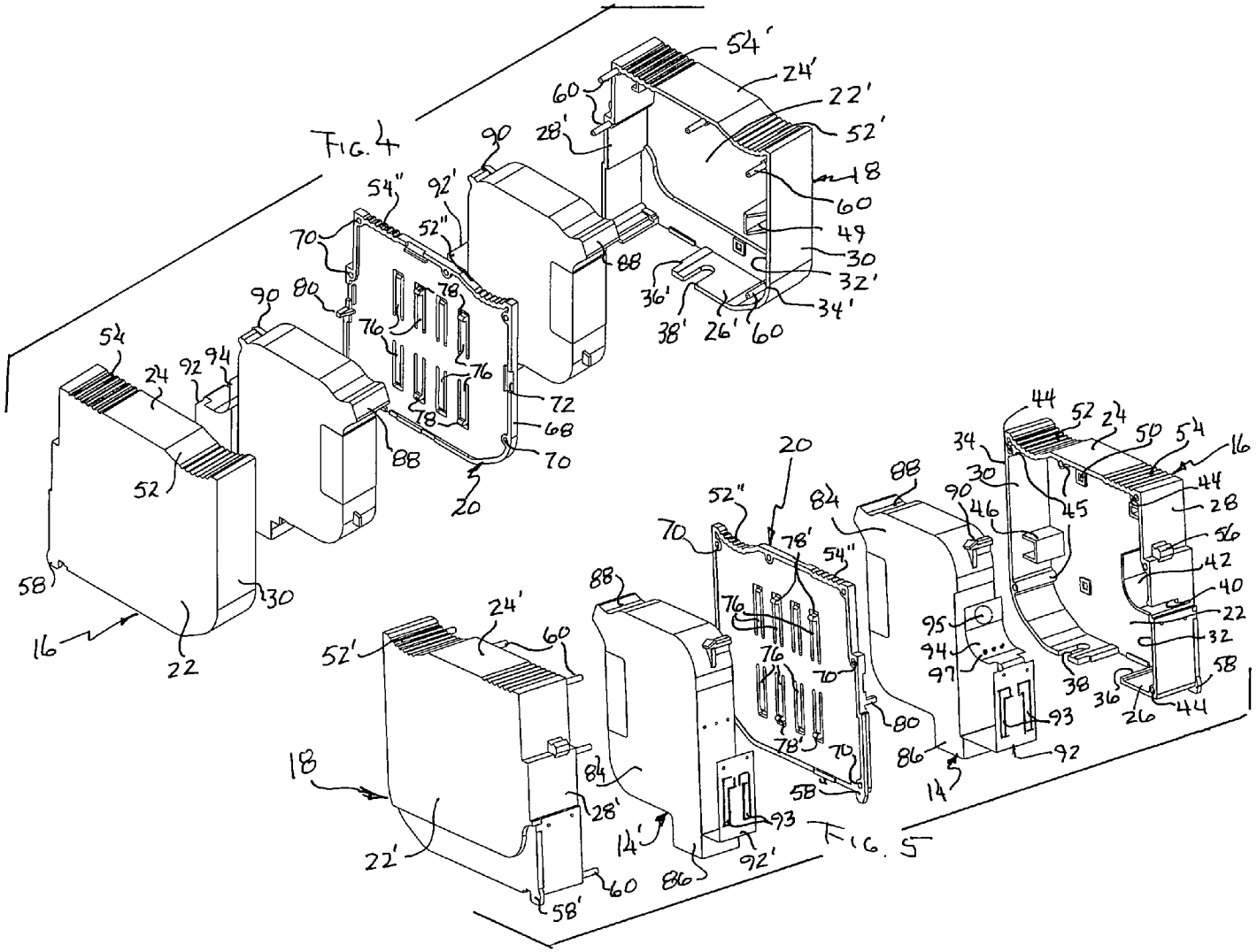
FIGS. 4 and 5 are exploded perspective views of the module taken from the right rear and left front, respectively.
Figure 6:
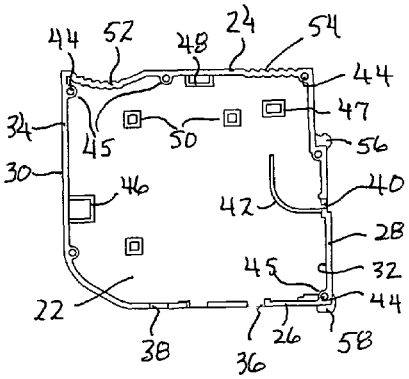
FIG. 6 is an elevational view of the right housing component, showing the interior thereof.
Figure 7:
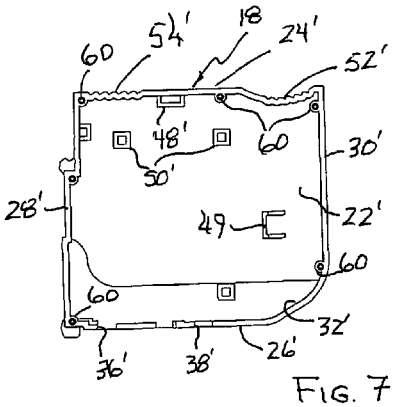
FIG. 7 is an elevational view of the left housing component, showing the interior thereof.
Figure 8:
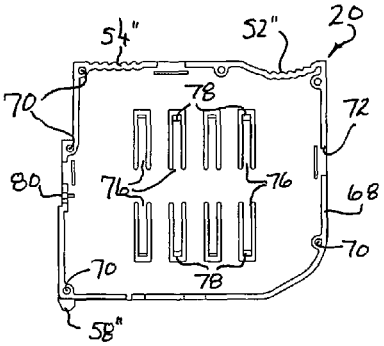
FIG. 8 is an elevational view of one side of the central panel component, the opposite side being essentially a mirror image thereof.

Turning now in detail to the appended drawings, therein illustrated is a module for mounting and use in a postage meter for printing postage, and the several components of which it is comprised. More particularly, the housing of the module, generally designated by the numeral 12, comprises right side and left side lateral components, generally designated respectively by the numerals 16 and 18, and a central panel component generally designated by the numeral 20 interposed therebetween. The housing contains two ink cartridges for ink-jet printing, generally designated by the numerals 14 and 14'.

The right side housing component 16 consists of a side panel 22 and a peripheral wall comprised of a top portion 24, a bottom portion 26, a front portion 28, and a rear portion 30. The side panel 22 and the peripheral wall portions 24, 26, 28, 30 define a cartridge-receiving cavity 32 in the component 16. The peripheral wall has a free inner edge 34, and a gap 36 is formed in the bottom portion 26 thereof. Slots 38 and 40 are formed in the bottom portion 26 and front portion 28 of the wall, respectively, and an upwardly curved wall section 42 extends inwardly from the bottom of the slot 40 into the cavity 32. Bores 44 extend laterally outwardly into receptacle elements 45 provided at several locations spaced about the component 16 along and beneath its peripheral wall.

Generally rectangular backstop elements 46, 47, 48, and bosses 50, are formed on, and project inwardly from, the inside surface of side panel 22. The top portion 24 of the peripheral wall is arcuately indented at 52 and has a corrugated surface to provide enhanced traction; a flat area 54 spaced forwardly of the indentation 52 is also corrugated for enhanced traction. A hook element 56 is formed on the front portion 28 of the peripheral wall, and a locating tab 58 is formed at the intersection of the bottom and front wall portions 26, 28; these elements coact with structures in a printer (not shown) to correctly locate and retain the module 12 therein.

The left side lateral component 18 is comprised of elements similar to those of the right side lateral component 16, and to that extent common numbers, differentiated however by the addition of prime marks, are used to designate them. The left housing component 18 additionally has a backstop element 49 formed thereon, which extends inwardly from the panel 22', and six pins 60 extend laterally inwardly from locations spaced about and underlying the peripheral wall.

The central panel component 20 has a peripheral edge portion 68 that mates with the free inner edges 34, 34' of the peripheral walls (24, 24', 26, 26', 28, 28', 30, 30') of the lateral housing components 16, 18; it also includes corrugated areas 52", 54" that align with the corresponding areas on the components 16, 18. In addition, apertures 70 extend through the central panel component 20 at spaced locations on its peripheral edge portion 68, and a short indentation 72 is formed along the rear edge of the central panel component to provide a "coin slot" in cooperation with the adjacent edge of the rear wall portion 30 of the lateral component 16.

Integrally formed in the central panel component 20 are eight fingers 76, which are attached at one end and have projecting stubs 78, 78' at their free opposite ends. As will be appreciated, the fingers are resiliently deflectable out of the plane of the panel component 20, and the stubs 78, 78' on alternating fingers 76 project respectively in opposite directions therefrom. A short bar element 80 extends laterally from the front edge of the component 20, and a locating tab 58" is formed at an intersection of the front and bottom edges of the peripheral portion 68; in assembly, the bar element 80 lies in the peripheral wall slot 40 to cooperatively define its T-shaped periphery.

Two ink cartridges for ink-jet printing 14, 14' are provided in the module 12. The cartridges are of standard construction, and each consists generally of a hollow body 84 for the containment of ink, an ink-discharge nozzle 86 at the bottom front of the cartridge, a handle formation 88 at the top rear, and a catch element 90 at the upper, forward shoulder.

An integrated circuit member 92, 92' is attached to a front surface of each cartridge 14, 14'. As is conventional, the members 92, 92' contain an array of electrical contacts and associated circuitry, diagrammatically illustrated at 93. The circuit member 92 includes a distal and portion 94, carrying a microprocessor 95 and electrical contact points 97 for programming it.

Figure 9:
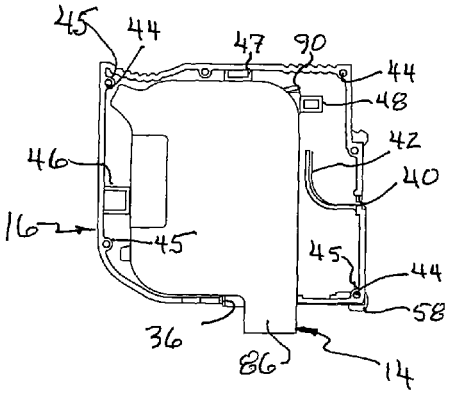
FIGS. 9 and 10 are elevational views showing an ink cartridge for ink-jet printing seated in the cartridge-receiving cavity of, respectively, the right and left lateral components of the housing of the module of the invention.
Figure 10:
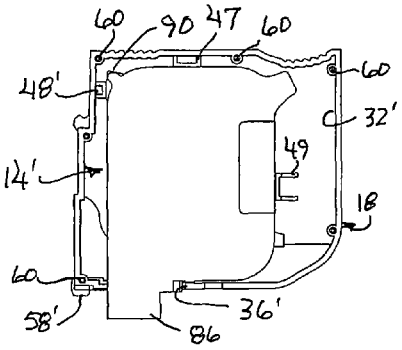

In assembling the module 12, the ink cartridges 14, 14' are initially introduced by placing them into the cartridge-retrieving cavities 32, 32' of the lateral housing components 16, 18, respectively; the resultant subassemblies are indicated in FIGS. 9 and 10. It will be noted that the backstop elements 46, 47, 48 and 49 snugly embrace the cartridges 14, 14' at the front, top, and back, and serve to accurately locate and secure them against a relative movement in the housing; the backup elements 48, 48' engage the catch elements 90 on the cartridges to afford particularly firm support against rotation of the cartridges in the cavities 32, 32'.

Following placement of the cartridges into the cavities of the lateral components, the central panel component 20 is disposed over the cartridge 14' seated in the cavity 32' of component 18, by inserting the pins 60 thereon through the apertures 70 in the central panel component 20. The lateral component 16, containing the cartridge 14, is then positioned over the central panel component 20 with the pins 60 aligned with the peripheral bores 44 in the component 16. Forcing the lateral components 16, 18 together secures the assembly by frictional engagement of the pins 60 within the bores 44.

In effecting assembly, the distal end portion 94 of the flexible circuit member 92 is caused to enter the slot 40 in the front peripheral wall portion 28 of the component 16, and to rest upon the curved wall section 42 adjacent thereto. The short bar 80 element that projects from the peripheral edge portion 68 of the central panel component 20 also enters the slot 40 and cooperates to define the T-shaped periphery and to maintain the circuit member 92 in place. Albeit preferred, the (inverted) T-shape is not necessary if a uniform slot provided is sufficiently wide (from top-to-bottom) to accommodate passage of the microprocessor(s) on the flexible circuit member.

It will be appreciated that the tabs 58, 58', 58" on the housing components 16, 18, 20, respectively, engage in mating structures of a postage meter (not illustrated) to properly locate the module and facilitate insertion. The fully inserted relationship is achieved with the application of manual force upon the housing, conveniently by pushing on the unified corrugated areas 54, 54', 54", urging the module forwardly and downwardly into the printer until the hook elements 56, 56' engage with a latching part that is conventionally provided in the printer.

It will be appreciated that the resiliently deflectable fingers 76 of the central panel component 20 serve the important function of biasing the cartridges 14, 14' toward the side panels 22, 22' defining their respective cavities 32, 32', causing the central panel component 20 to optimally cooperate with the several backstop elements 46, 47, 48, 49 for maintaining the cartridges firmly seated and securely fixed in positions within the housing, and thus within a postage printer. As will be apparent, the central panel component 20 (as well as the other components 16, 18 of the housing) will normally be fabricated from a suitable synthetic resinous material so as to inherently provide the desired resiliency to the fingers 76, molded thereinto.

It will be appreciated that variations may be made in the housing and module of the invention without departure from the scope of the appended claims, as will be evident to those skilled in the art. For example, securing means other than coacting pins and holes may be provided for assembling the lateral housing components; various latching and other interengaging elements are well known in the art and may be employed, as appropriate. The securing means may or may not permit disassembly and reassembly (for reloading and remanufacture of the module). The use of engaging pins that release wholly and cleanly from cooperating holes would, for example, readily permit reassembly. On the other hand, reassembly would be prevented (or at least inhibited) by, for example, forming engaging pins of a frangible material, or as a mechanically weak or weakened structure, so as to fracture upon separation of the components; remanufacture may also be prevented by bonding or welding of the housing components to one another.

Similarly, means other than the integral, resiliently deflectable fingers (for example, raised arcuate elements) may be provided on or by the central panel component for exerting biasing and stabilizing force upon the contained ink cartridges. As previously indicated, resiliently deflectable fingers are most conveniently provided by forming them in the course of molding of a suitable plastic material. However, other fabrication means and materials may be employed for the several housing components, as may be appropriate and desired.

Finally, albeit the present module is particularly constructed for use in a postage printer, the concepts disclosed herein may be equally applicable for the provision of modules suitable for use in other printing machines.

Thus, it can be seen that the present invention provides a novel housing for containing standard ink-jet printing cartridges, and a novel inking module comprised of an assembly of such a housing and two ink cartridges. The housing is of relatively incomplex and inexpensive construction, and facilitates secure, stable, and simplified assembly with standard ink-jet printing cartridges, by way of lateral loading rather than insertion from the top, to provide a module that is of sleek and aesthetically pleasing appearance and that enables ready installation in a standard postage meter. The housing may be constructed for facile manual disassembly and reassembly of its components to permit ready replacement of ink-jet printing cartridges for reloading and remanufacture of the module.

Having thus described the invention, what is claimed is:

1. A module for mounting and use in a postage meter for printing postage, comprising:

a housing comprised of a pair of similarly configured lateral components, each lateral component including a side panel having a peripheral edge and a peripheral wall extending laterally from said peripheral edge, said peripheral wall having a free inner edge and comprising a top portion, a bottom portion, a front portion, and a rear portion and defining, with said side panel, an ink cartridge-receiving cavity in each of said lateral components, said bottom portion of said peripheral wall of said each lateral component having a gap therein that extends from said free edge thereof toward said side panel for receiving therethrough the ink-discharge nozzle of a contained ink cartridge, and said front portion of said peripheral wall of at least one of said lateral components having a slot therein that extends from said free edge of said front portion of said peripheral wall toward said side panel of said one of said lateral housing components and is dimensioned and configured for the receipt therethrough of a flexible electrical circuit member; a generally planar central panel component having a peripheral edge portion, said lateral components and said central panel component being so dimensioned and configured that said free edges of said peripheral walls of said lateral components engage said peripheral edge portion of said central panel component when said lateral components are assembled against opposite sides of said central panel component; and means for securing said lateral components and said central panel component in assembly with said lateral components positioned, and so engaged, on opposite sides of said central panel component; and two ink cartridges for ink-jet printing, each of said cartridges having an ink-discharge nozzle and having a flexible electrical circuit member attached thereto for operative electrical connection to a postage meter for controlling the discharge of ink through said nozzle thereof;

whereby said module comprises an assembly of said lateral housing components positioned on opposite sides of said central panel component and secured, by said securing means, with said free edges of said peripheral walls of said lateral components engaging said peripheral edge portion of said central panel component, one of said ink cartridges being seated in said cartridge-receiving cavity of each of said lateral components with said central panel component interposed between said cartridges and with said ink-discharge nozzles of said ink cartridges and said attached, operatively connected flexible electrical circuit members extending through said gaps in said bottom portions of said peripheral walls of said lateral components to provide portions of said circuit members exposed on the exterior of said front portions of said peripheral walls of said lateral components, said flexible electrical circuit member of said ink cartridge seated in said cavity of said at least one of said lateral components extending through said slot in said front portion of said peripheral wall thereof and having a distal end portion, which carries a microprocessor and programming points therefor, contained in said ink cartridge-receiving cavity of said one of said lateral components.

2. The module of claim 1 wherein said edges of said peripheral walls of said lateral components of said housing engage said peripheral edge portion of said central panel component of said housing in direct surface contact.

3. The module of claim 1 wherein said housing is generally symmetrical, in external configuration, about a plane of said central panel component.

4. The module of claim 1 wherein said central panel component has means thereon for exerting laterally outword biasing force upon both of said ink cartridges seated in said cartridge-receiving cavities of said lateral housing components.

5. The module of claim 4, wherein said means for exerting lateral force is integrally formed on said central panel component.

6. The module of claim 1 wherein said electrical circuit member is of strip form.

7. A housing for the containment of two ink cartridges for ink-jet printing to provide a module for mounting and use in a postage meter for printing postage, said housing being comprised of a pair of similarly configured lateral components, each lateral component including a side panel having a peripheral edge and a peripheral wall extending laterally from said peripheral edge, said peripheral wall having a free edge and comprising a top portion, a bottom portion, a front portion, and a rear portion and defining, with said side panel, an ink cartridge-receiving cavity in each of said lateral components, said bottom portion of said peripheral wall of said each lateral component having a gap therein that extends from said free edge thereof toward said side panel for receiving therethrough the ink-discharge nozzle of a contained ink cartridge, and said front portion of said peripheral wall of at least one of said lateral components having a slot therein that extends from said free edge of said front portion of said peripheral wall toward said side panel of said one of said lateral housing components and is dimensioned and configured for the receipt therethrough of a flexible electrical circuit member; a generally planar central panel component having a peripheral edge portion, said lateral components and said central panel component being so dimensioned and configured that said free edges of said peripheral walls of said lateral components engage said peripheral edge portion of said central panel component when said lateral components are assembled against opposite sides of said central panel component; and means for securing said lateral components and said central panel component in assembly with said lateral components positioned, and so engaged, on opposite sides of said central panel component, said housing being generally symmetrical, in external configuration, about a plane of said central panel component.

8. The housing of claim 7 wherein said free edges of said peripheral walls of said lateral components of said housing engage said peripheral edge portion of said central panel component in direct surface contact.

9. The housing of claim 7 wherein said means for securing is constructed to secure said lateral housing components and said central panel component disengageably, to permit disassembly of said housing.

10. The housing of claim 9 wherein said means for securing is constructed to permit reuse thereof for securing said components in assembly after disassembly from one another, so as to enable replacement of said ink cartridges.

11. The housing of claim 10 wherein at least one indentation is provided between said peripheral edge portion of said central panel component and said free edge of one of said lateral housing components for receiving a tool to facilitate manual prying apart of said components.

12. The housing of claim 9 wherein said means for securing is constructed to prevent reuse thereof for securing said components in assembly after disassembly from one another.

13. The housing of claim 7 wherein said means for securing comprises a plurality of pins extending laterally inwardly from at least one of said lateral housing components and a corresponding plurality of bores in at least the other of said lateral housing components, said pins on said at least one of said lateral components being aligned with said bores in said at least the other of said lateral components and said pins and said bores being dimensioned and configured for interengagement to secure said components of said housing in assembly; and wherein a plurality of apertures are provided in said central panel component, said apertures being dimensioned, configured, and spaced about said central panel component for receiving therethrough said plurality of pins on said at least one of said lateral housing components.

14. The housing of claim 7 wherein said central panel component has means formed thereon for exerting laterally outward biasing force upon an ink cartridge seated in said cartridge-receiving cavity of each of said lateral components.

15. The housing of claim 14 wherein said means for exerting lateral biasing force comprises a multiplicity of resiliently deflectable fingers integrally formed on said central panel component, each of a first plurality of said fingers having a contact element thereon that projects from one side of said central panel component, and each of a second plurality of said fingers having a contact element thereon that projects from a second side thereof.

16. The housing of claim 7 wherein support structure is provided within said cavity of said at least one of said lateral components adjacent said slot in said front portion of said peripheral wall thereof for supporting a distal end portion of a flexible electrical circuit member that may be inserted inwardly through said slot.

17. The housing of claim 16 wherein said slot in said front portion of said peripheral wall is of inverted, generally T-shaped configuration.

18. The housing of claim 7 wherein each of said components of which said housing is comprised has a locating tab at a bottom, front corner portion thereof for facile and correct positioning of said housing in a postage meter.

* * * * *